United States Patent [19]

Lipinski et al.

[11] Patent Number: 4,952,000

[45] Date of Patent: Aug. 28, 1990

[54] METHOD AND APPARATUS FOR INCREASING THE EFFICIENCY OF HIGHWALL MINING

[75] Inventors: Thomas Lipinski, Winchester; Eugene Dunaway, Nicholasville; Manfred Jasser, Versailles, all of Ky.

[73] Assignee: Thin Seam Miner Patent B.V., The Netherlands, Netherlands

[21] Appl. No.: 342,282

[22] Filed: Apr. 24, 1989

[51] Int. Cl.[5] ..... F21C 35/24; G06G 7/66

[52] U.S. Cl. ..... 299/1; 299/30; 364/420

[58] Field of Search ..... 299/1, 10, 30, 64; 175/45; 364/420

[56] References Cited

U.S. PATENT DOCUMENTS

| | | | |
|---|---|---|---|
| Re. 31,622 | 7/1984 | Todd | 299/1 |
| 3,362,750 | 1/1968 | Carnegie | 299/1 |
| 3,531,159 | 9/1970 | Schmidt | 299/1 |
| 3,922,015 | 11/1975 | Poundstone | 299/1 |
| 3,996,452 | 12/1976 | Schulze et al. | 235/150.1 |
| 4,008,921 | 2/1977 | Czauderna | 299/1 |
| 4,016,942 | 4/1977 | Wallis, Jr. et al. | 175/45 |
| 4,023,861 | 5/1977 | Schnell | 299/1 |
| 4,033,626 | 7/1977 | Dinkelbach | 299/1 |
| 4,070,063 | 1/1978 | Kogler et al. | 299/64 |
| 4,133,582 | 1/1979 | Kogelmann | 299/64 |
| 4,160,566 | 7/1979 | McGee | 299/30 |
| 4,228,508 | 10/1980 | Benthaus | 364/420 |
| 4,262,964 | 4/1981 | Ingle | 299/1 |
| 4,280,732 | 7/1981 | Haspert | 299/11 |
| 4,334,271 | 6/1982 | Clavier | 364/422 |
| 4,346,593 | 8/1982 | Howells et al. | 73/152 |
| 4,386,664 | 6/1983 | Miller | 175/45 |
| 4,407,017 | 8/1983 | Zhilikor et al. | 364/420 |
| 4,452,075 | 6/1984 | Bockhorst et al. | 73/151 |
| 4,567,759 | 2/1986 | Elkstrom et al. | 73/152 |
| 4,648,268 | 3/1987 | Grosjean | 173/152 |
| 4,715,657 | 12/1987 | Sato et al. | 299/1 |
| 4,733,733 | 3/1988 | Bradley | 175/45 |
| 4,734,860 | 3/1988 | Elgi | 364/422 |

FOREIGN PATENT DOCUMENTS

| | | | |
|---|---|---|---|
| 0141799 | 5/1985 | European Pat. Off. | 299/1 |
| 562654 | 8/1977 | U.S.S.R. | 299/1 |
| 1250651 | 8/1986 | U.S.S.R. | 299/1 |

*Primary Examiner*—Bruce M. Kisliuk
*Assistant Examiner*—David J. Bagnell
*Attorney, Agent, or Firm*—Wood, Herron & Evans

[57] ABSTRACT

A highwall mining machine having a power head located on a bench adjacent the highwall and a cutter head operable to cut a mined hole into a coal seam when thrust forward by the cutter head through an intervening compression beam multisection includes sensors for measuring the inclination of the cutter head and the cutter drum boom on the cutter head for the taking of multiple measurements of the hole position and the coal thickness as the hole is being mined. The data is stored for consecutive mined holes. A display is generated to produce a map of the hole and seam boundaries for the operator so that the operator can set or override programmed settings of the machine controls in further guiding the machine. The data also produces automatic computations of mined coal amount, coal mining rate, and unmined coal remaining or of the recovery rate.

40 Claims, 8 Drawing Sheets

$$\overline{Q_N} = \frac{Q_N + Q_{N+I}}{2}$$

$$DY_N = DX_N \cdot \tan \overline{Q_N}$$

$$Y_N = \sum_{I=O}^{N} DY_I$$

$$Z_N = Y_N + H_N$$
$$G_N = Y_N + L_N$$
$$U_N = H_N - L_N$$
$$S_N = U_N \cdot W$$

$$V_N = S_N \cdot DX_N$$
$$P_N = V_N \cdot K$$
$$T_N = T_C \cdot \left(\frac{DX_N}{X_T + X_B}\right)$$
$$E_N = \frac{V_N}{T_N}$$

| POWER HEAD HORIZONTAL TRAVEL | | | | |
|---|---|---|---|---|
| SUMP | DEPTH | | SPEED | |
| TOP | 14 | 14 | 75 | 0 |
| BOTTOM | 12 | 12 | 55 | |
| | PRO-GRAM | ACTUAL | PRO-GRAM | ACTUAL |

FIG. 6

| CUTTER BOOM VERTICAL TRAVEL | | | | |
|---|---|---|---|---|
| SHEAR | HEIGHT | | SPEED | |
| TOP / UP | 55 | 34 | 87 | 87 |
| BOTTOM / DOWN | 0 | 0 | 74 | |
| | PRO-GRAM | ACTUAL | PRO-GRAM | ACTUAL |

FIG. 6A

| KEYPAD |
|---|
| SELECT PROGRAM VARIABLE TO CHANGE |
| ENTER NEW VALUE FOR SELECTED VARIABLE |

FIG. 6B

METHOD AND APPARATUS FOR INCREASING THE EFFICIENCY OF HIGHWALL MINING

The present invention relates to highwall mining and more particularly to the control of high-wall mining machinery through the automated acquisition and use of information regarding the location and shape of the boundaries of the mined holes and the coal seam.

BACKGROUND OF THE INVENTION

Highwall mining is a procedure for extracting coal or other mineral from a thin seam with remote control machinery which extends into the seam from a bench at the surface of a highwall. A highwall is a vertical or steeply sloped face of an excavation which has been cut on a mountain side or has been exposed by the digging of a pit in the course of a surface mining operation. The portion of the seam which has been removed by the mining excavation will leave a relatively flat and generally horizontal surface at the base of the highwall referred to as the bench. As a result, at the base of the highwall will be found an artificial outcrop of coal or other mineral underlying an overburden of soil and rock. From the outcrop a continuation of the mined seam will extend into the earth or under the mountain.

The creation of highwalls is in part due to the economic factors involved in strip mining. The cost of exposing and removing coal from a seam is related to the amount of overburden which must be removed to expose the seam. As the surface mining operation progresses, if the overburden progressively thickens, it eventually ceases to be economical to continue surface mining. This is because the amount of overburden material which must be removed per given amount of coal recovered reaches a ratio at which it is no longer cost effective to proceed. As a result, the seams of the coal remaining beyond the face of the highwall must be mined, if at all, by other techniques.

With seams of this type, the thickness is frequently too small to allow the mining to be economically carried out by miners working within the seam. Often, the seam may be no more than two to three feet in thickness. For this reason, the art of highwall mining is undertaken by the use of remote control machinery.

Early efforts to mine a coal seam from a highwall included the use of coal augers to bore circular holes in the coal seam. Auger mining was employed to mine coal seams from benches cut in mountainsides or left from surface mining operations. These auger devices, however, made poor utilization of the natural coal. Often the coal removed was contaminated with material from outside the seam since there was no effective method for guiding the advancing auger.

Other developments in highwall mining involved the use of continuous mining machines which were remotely controlled to proceed into a coal seam. These machines were followed into the mined hole by open conveyor vehicles which removed the coal to the surface. Such devices, as for example one referred to as the Push Button Miner developed by Joy Manufacturing Co., were only marginally effective and have been practically abandoned.

More recent developments in highwall mining machines have been more successful. One such machine is disclosed in U.S. Pat. No. Re 31,622 issued to Robert E. Todd. Machines such as those shown in Todd Reissue Patent No. 31,622 represent a substantial improvement over prior equipment and methods for mining thin seams from a highwall.

The Todd miner includes a cutter head which is driven into the coal seam by a rectangular compression beam which is assembled in sections behind the mining head and is thrust from a baseframe at a bench outside of the mined hole at the surface of the highwall. The mining head is similar to that of a continuous mining machine. Such machines permit deep entry into the coal seam, sufficient recovery of resources and economical production of coal. Guidance of the cutting heads of such machines has heretofore been a work of art, depending highly upon the skill and experience of the human operator. The efficiency and effectiveness of operator directed guidance has been limited by the difficulty in locating the boundaries of coal seams which may be hundreds of feet removed from the operator and in positioning the cutter heads within inches of such boundaries to mine the coal.

With the highwall mining of coal, as with any mining operation, it has been a general objective to extract from the earth the maximum amount of coal at the minimum cost. Costs in the mining of coal are usually directly related to the time during which equipment and labor is in use. Labor costs are commonly related to man hours of work, while equipment costs too can be related to the amortization of capital and maintenance over equipment life. Thus, a basic ingredient in the cost of produced coal is expressed in a certain unit of cost per unit time of operation. The coal produced during that unit time is thus produced at the cost of operation for that unit time. Thus, the general objectives in coal mining have been to increase the coal production per unit hour and to decrease the cost per unit hour to increase the amount of coal produced per dollar expended. This has been the ultimate objective of coal mining operators.

An additional objective in the coal mining industry has been the economic use of the mineral resources of the land. It is important to the owners of the land containing coal, to the owners of the mineral rights to the land, and to the nations concerned with conserving energy resources that the percentage of the coal recovered from the land by the mining operation be maximized. The technique of highwall mining has increased recovery of coal by providing, in many cases, the ability to mine coal which cannot be economically mined by any other process. This is due in part to its ability to recover coal from the seams which are too thin to be mined by any other process. Nonetheless, it is still important that the highwall mining process recover the maximum amount of coal which can be recovered by that process.

One occurrence in highwall mining which results in a reduced recovery of coal from a coal seam is a failure to mine close to the boundary of the coal seam. Accordingly, as a highwall mining machine mines a hole into a coal seam, a layer of coal will remain near the top and bottom of the mined hole leaving a greater thickness of coal than necessary adjacent these mined holes. This necessarily reduces the recovery percentage of the coal. Moving the cutters close to the coal seam boundary results in removal of a greater amount of coal, but also runs the risk of cutting beyond the boundary of the coal seam which will remove out of seam material along with the coal. When this occurs, the rock mixed with the coal, referred to as the ash content of the coal, can greatly reduce the value of the coal on the market. The value reduction often will more than offset the value of the coal which would be lost by leaving a greater thickness of coal in the seam. By taking greater care to mine close to the boundary without crossing the boundary, a higher recovery of cleaner more valuable coal results, but the mining process is slowed and accordingly the cost of the coal per unit ton of coal mined is increased due to the overall slowing of the mining operation.

A problem which has been encountered in high wall mining has been the lack of knowledge of the boundaries of the coal seam adjacent to and in advance of the cutter head. The employment of coal thickness sensors of various types has been common with highwall mining machines developed in the last ten years. One type of sensor used has been the sensitized pick which is capable of detecting differences in physical properties of the material at the mined surface to distinguish between coal and the material outside of the seam. Other such sensors have, for example, included natural radiation sensors, which measure the strength of the natural gamma radiation originating from the surrounding clay based rock. This radiation is attenuated by the thickness of the coal. Such sensors, when positioned on the highwall mining machine cutter head, are capable of producing a measurement signal representative of the thickness of the coal between the boundary of the mined hole and the boundary of the coal seam.

The positions of such sensors, however, do not lie ahead of the advancing cutter but must necessarily be within the hole already mined. At best, the positioning of such sensors is at the leading edge of the cutter within the mined hole. However, the cutting site is not the most ideal environment for the proper operation of such scientific instruments even those adapted for heavy industrial uses. The risk of mechanical damage to the sensors in this region, as well as the interference with their accurate measurements of coal, dust, and debris, usually requires that the sensors be positioned somewhat behind the leading cutting edge of the cutter head. Accordingly, the fact that the sensors would thus be located several feet behind the cutting interface diminishes the value of the measurements in guiding the actual positioning of the cutters, since prediction rather than accurate measurement of the coal seam interface must be relied upon.

The ability of prior art techniques to provide an accurate prediction of the coal seam boundary so as to provide a basis for guidance of the machine cutter head in the mining of the seam ahead of the cutter head has been inadequate and unsatisfactory. Accordingly, there has been a need for an improved manner of predicting for purposes of effectively controlling the movement of the cutters and cutter head of a highwall mining machine within the coal seam.

Certain prior art techniques have been developed for guiding mining machines to cut near the boundaries of coal seams. In the art of longwall mining for example where the cutter heads of mining machines are precisely positioned on firmly anchored rails and thrust against the coal from firmly anchored and precisely positioned beams and columns, some semblance of program control has been attempted. With such programs, information from mining pass measurements has been used to determine the extensions of the coal seam boundaries and thereby guide the machine. Such techniques have not been suggested nor been regarded as at all practical for highwall mining machines where the cutter heads may be several hundred feet from the bench on which the power head driving the cutter head is anchored and where cutter heads are not in physical contact with a previous cut. With the cutter head linked through a multisection articulating compression beam to the power head, and where the mined hole is not contiguous with the previous mining pass but is rather through a totally separate mining hole, predicting the seam extensions and locating the cutting equipment has lacked enough accuracy to avoid errors in the guiding and controlling of the mining machine. Accordingly, there is a need in the prior art for providing a method for not only mapping the boundaries of a coal seam in such a way that the information would be useful for guiding highwall mining machines, but also to provide a manner to practically use the information in a way to overcome the uncertainties involved in extrapolating and predicting the course of the coal seam ahead of the cutter head in a separately mined hole.

SUMMARY OF THE INVENTION

It is an objective of the present invention to provide a method and apparatus for increasing the efficiency of a highwall mining operation and accordingly to reduce the ultimate cost per ton of the coal mined thereby. It is a further objective of the present invention to provide a method and apparatus which will enhance the percentage recovery of coal from a coal seam without unacceptably reducing the efficiency of the mining operation or increasing the cost of the mined coal.

It is a more particular objective of the present invention to provide a method and apparatus for more effectively acquiring and utilizing information regarding the location of the boundaries of the coal seam within the earth, particularly those ahead of the highwall mining machine cutter head, and also for acquiring and utilizing information with respect to the location of the highwall mining machine within the earth and in relation to the location of the coal seam boundaries.

It is a further objective of the present invention to utilize effectively information acquired with respect to the location of the boundaries of the coal seam, the mined hole, and the location of the mining machine within the earth for controlling the operation of the mining machine and for guiding the mining machine in cutting the boundaries of the mined hole and in advancing the machine cutter head into the seam.

It is a general objective of the present invention to achieve a higher rate of recovery of coal from the mined seam, to achieve a higher percentage of recovery of the coal from the mined seam, and to reduce wasted time in the operation of the mining machine and the frequency of excursions of the mining machine cutting elements from the coal seam which would increase the ash content of the coal.

It is an additional specific objective of the present invention to provide a method and apparatus for the determination of the amount of coal being mined, the rate of which the coal is being mined, and the percentage of recovery of the coal from the seam.

In accordance with the principles of the present invention, a highwall mining machine is provided together with a method for controlling the mining machine which utilizes information acquired through measurements of the positions of components of the mining machine cutter head within the earth, a measurement of the boundaries of the coal seam in which the cutter head is mining, and the combination of such information with information from previously mined adjacent holes within the seam to position the equipment and to map the coal seam and the holes mined therein. Further provided is the method and apparatus which facilitates the use of the information regarding the positioning of the equipment and the location of the coal seam and mined hole boundaries for use in controlling and guiding the mining machine.

In accordance with a preferred embodiment of the present invention, there is provided a method and apparatus in which the relative positions of machine components are measured as well as the orientation of machine components with respect to the earth to locate the position of the cutters of the machine as a hole is mined in the coal seam. Additionally, a highwall mining machine is provided having inclinometers on the machine components, particularly on the cutter head and cutter drive arm, which determine the inclination of the mining machine cutter head and the cutting elements thereon to determine the position of the mining machine within the earth with respect to the bench on which the power head of the mining machine is located and to thereby determine and map the boundaries of the hole cut by the machine in the earth.

The mining machine is further provided with sensors positioned on the cutter head to measure the coal thickness remaining adjacent the mined hole. In the preferred embodiment, preferably the sensors are located immediately behind the cutter head and directed upward and downward so as to produce signals of coal thickness above and below the mined hole. The information derived from these measurements is, by the apparatus provided in accordance with certain aspects of the present invention, processed to produce stored data images of the mined hole and the boundary of the coal seam immediately adjacent to the mined hole. In accordance with further principles of the present invention, similar data from the immediately adjacent and previously mined hole is similarly stored. The stored data for two or more adjacent mined holes is retrieved and made available for comparison and for analysis so that the results of the comparison and analysis can be used to control and guide the mining machine, and to predict for purposes of controlling and guiding the mining machine, the boundaries of the coal seam in relation to the position of the mining equipment. In accordance with a particular embodiment of the present invention, further sensors are provided to monitor the power drawn by the cutter drive elements to produce a signal related to the hardness or other characteristic of the mined material. Such sensors provide an additional and more immediate indication, in some circumstances, of excursions of the cutter from the seam. The operator or a program is provided the option to elect among plural measurements to utilize, according to certain criteria, the more reliable or useful data for guidance of the machine.

In accordance with one particular objective of the present invention, the retrieved information is used to program further mining cuts and for directing and guiding the machine. Additionally, the stored information is displayed, preferably in graphic form, for the use of a human operator so that the operator may employ his own knowledge, experience, and judgment and skill to accept or override established controlled parameters of the machine and to more effectively and efficiently control and guide the operation of the machine to accomplish the objectives of the invention set forth above, particularly for increasing the rate and efficiency of the mining operation and the more complete recovery of coal. Specifically, in accordance with a preferred embodiment of the present invention, a graphical presentation is displayed for the operator illustrating the upper and lower boundaries of the current mined hole and the thickness of the remaining coal above and below the mined hole. Also displayed along with the hole and seam boundaries for the hole currently being mined is similar data for the hole immediately adjacent the mined hole which was previously mined. In this way, the patterns displayed showing the shape of the coal seam from the previously mined hole may be projected and extrapolated to aid in prediction of the course of the coal seam boundaries ahead of the cutting head in the currently mined hole. This enables the operator to add his own intelligence and judgment to predictions and extrapolations of seam contour such as may be provided by data or a program. This information can further be used in either programming the guidance and control of the mining machine or in assisting the human operator in making decisions with respect to the direct guidance and control of the machine or in the modification of any program for guiding and controlling the machine.

In accordance with further principles of the present invention there is provided the automated processing of the data obtained in measuring of the mined hole to compute the current and cumulative mining rate being achieved by the operation of the mining equipment in accordance with the control parameters provided, and the output of signals representative of the total volume as well as the volume rate of coal being mined and the percent recovery of coal from the coal seam. Such information is either fed back automatically or manually by the operator to optimize the operation of the machine.

The present invention is predicated in part upon not only the realization that a certain amount of program control of the mining equipment and the use of predictive techniques is useful in efficiently and effectively guiding and operating a highwall mining machine, but also, and even more importantly, upon the realization that coal seam boundary prediction and machine control and guidance regardless of how sophisticated the program control techniques are which may be employed, will benefit by the ability of a skilled and experienced operator to modify or supply control and guidance commands in addition to, or instead of, program control commands where to do so would be beneficial in improving the efficiency and operation of the mining equipment. This realization is based in part upon the appreciation of the fact that a certain amount of the behavior and geology which affects the shape of coal seams is not easily quantifiable, and to the extent that it may be quantifiable, complete measurements of the data needed to precisely predict the seam contours are not also readily available or practically obtainable. Accordingly, the present invention provides for an operator interface between the information acquired by the measurement and sensing portions of the apparatus and the control portions of the equipment is provided.

Accordingly, the present invention provides the advantages of allowing the machinery to operate efficiently and effectively in highwall mining and to accommodate an operator by providing automatically derived information so that controls of the equipment can be achieved for guiding the machine and cutting the mined holes by the operator based on his judgment and experience in the operation of the equipment and in the art of highwall mining.

In accordance with the present invention, the advantages are provided for making available information regarding the mining rate and the coal recovery percentage so that the operator may instantaneously evaluate the effectiveness of the set operational parameters of the mining equipment and to determine whether or not changes and improvements are needed to the setting of the parameters to optimize the operating efficiency and recovery percentage with the highwall mining machinery.

These and other objectives and advantages of the present invention are more readily apparent from the following detailed description of the drawings in which:

DESCRIPTION OF THE DRAWINGS

FIGS. 6, 6A and 6B are control panel and screen diagrams illustrating the numerical information and controls accessible to the operator of the highwall mining machine of FIG. 1.

DETAILED DESCRIPTION OF THE DRAWINGS

Highwall seam mining machines of the type to which the present invention relates are those such as the thin seam mining machine described in detail in Todd U.S. Reissue Pat. No. Re 31,622 which is hereby expressly incorporated into this specification by reference.

Figure 1:
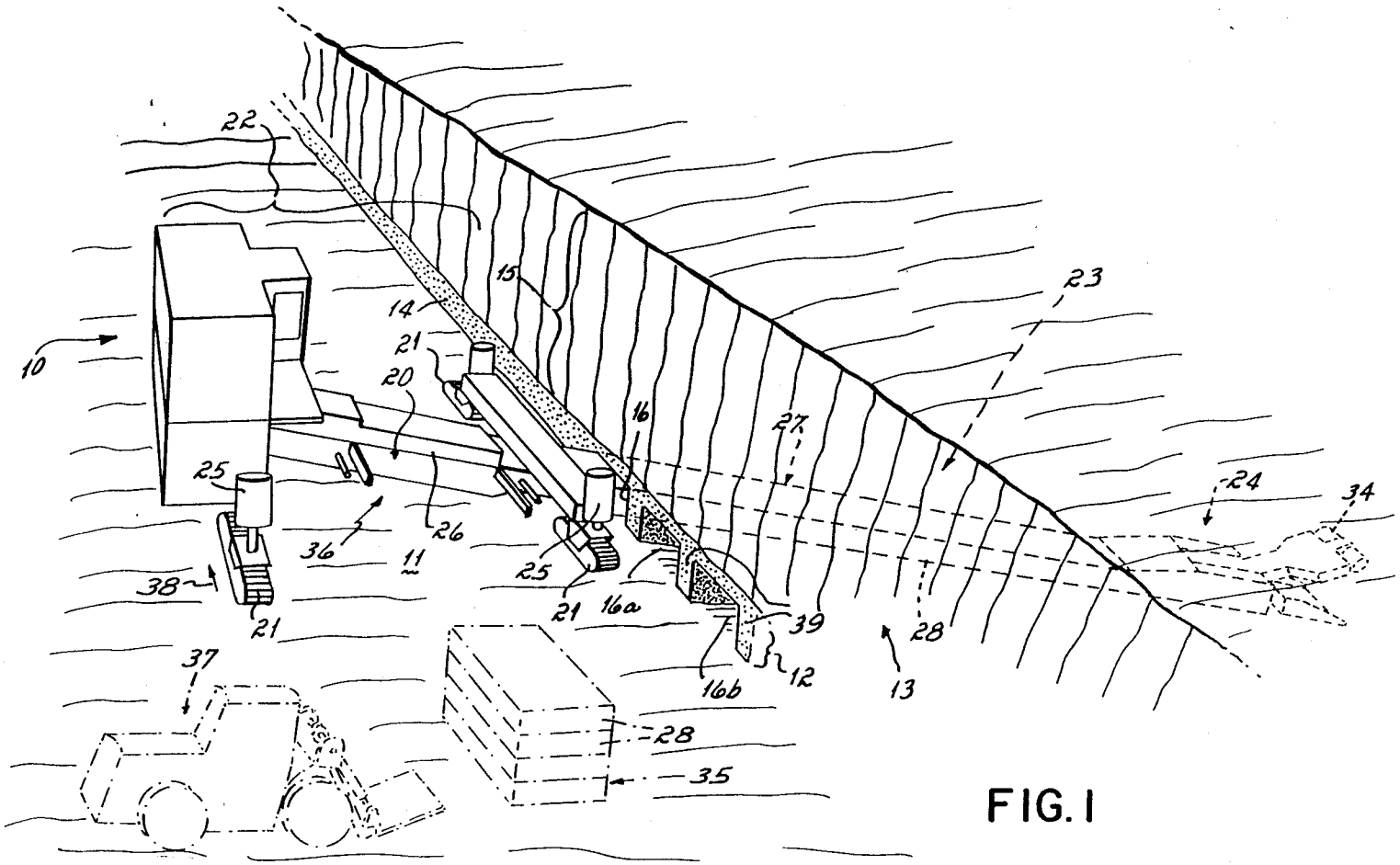
FIG. 1 is a perspective diagrammatic view of a highwall mining machine in which is embodied the principles of the present invention.

A highwall mining machine 10 embodying the present invention is illustrated in FIG. 1. The highwall mining machine 10 is a remote control mining machine for mining coal from the bench or surface area 11. The bench or surface area 11 will, in many cases, involve a pit which remains after the completion of the strip mining of a coal seam 12. The floor of this pit is generally referred to as the bench 11. The bench 11 is the top of the geological layer which formerly had underlied a coal seam 12 which had been partially removed, and is often the exposed upper surface of the extension of the rock strata immediately underlying the seam 12. The bench 11 forms the platform from which coal from the seam may be moved.

The termination of the strip mining operation will have left what is referred to as a highwall 13. A highwall 13 is the face of the excavation which includes an outcrop 14, which is the exposed face of the coal seam 12 at the highwall 13, and an overburden 15 of rock and soil above it. The outcrop 14 of the coal seam 12 will typically be at the base of the highwall 13. Highwall mining is the practice of removing coal from the seam through holes 16 mined into the seam 12 at the outcrop 14 of the highwall 13. Highwall mining through the use of a thin seam or highwall mining machine 10 is one of the methods by which highwall mining is accomplished and the one to which most of the aspects of the present invention relates.

The highwall mining machine 10 is provided with a baseframe 20 which is designed to be moved by a track drive system 21 on the bench 11 along the outcrop 14 of the seam 12 and positioned adjacent the seam 12. The baseframe 20 supports the surface unit 22 of the mining machine 10 from which extends the cutter string portion 23 of the machine 10. The cutter string 23 includes a cutter head module 24, which cuts and enters into the mined hole 16, and usually one or more pushbeam sections which extend the length of the cutter string 23. When the surface unit 22 is positioned, the weight of the baseframe 20 is capable of firmly anchoring to the bench 11 with sufficient firmness to apply thrust to the portion 23 of the machine 10 extending into the mined hole 16.

Figure 4:
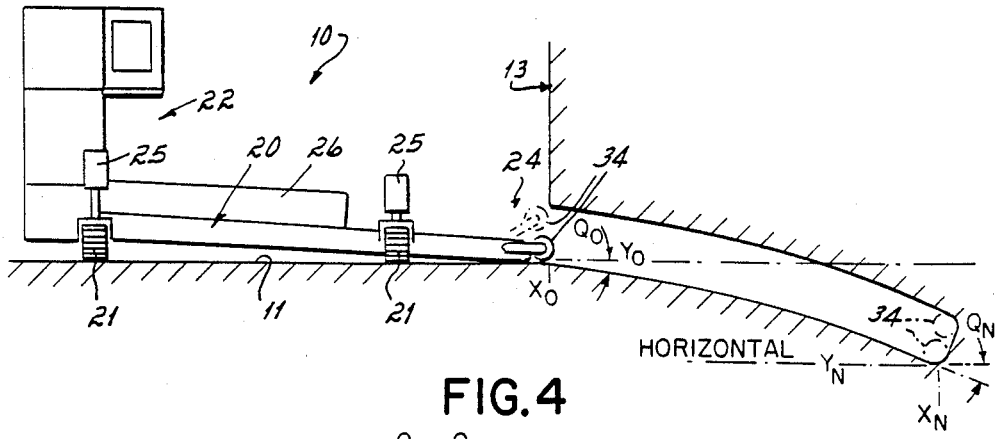
FIGS. 4, 5, 5A and 5B are diagrams illustrating the geometric variables employed in the description and flowcharts.

The track drive system 21 includes four individually steerable and controllable crawler assemblies which can raise and lower the frame 20 which carries the machine. The crowbars are attached to the frame 20 by vertically movable hydraulic cylinders 25 mounted between the base 20 and the crawlers 21. The baseframe 20 comprises a longitudinal set of rails which are directed toward the coal seam 12. The rails are oriented by the crawlers 22 parallel to the top of the bench 11 and to the last adjacent mined hole. The mined holes are set with a heading usually established by a site survey. The frame 20 may be raised, lowered, leveled or tilted by the operation of the cylinders 25 so as to produce the desired initial hole orientation. The angle which the baseframe 20 makes with the true horizon is the initial angle of inclination of the cutter head 24 as it begins to cut the mined hole 16. This angle, as seen in FIG. 4, will be referred to as $Q_O$ and is the angle at a hole depth of zero, hereinafter referred to as $X_O$.

Supported on the frame 20 is a power head 26. The power head 26 carries an electric or hydraulic ram (not shown) arranged to push or pull the cutter head with several hundred pounds of force, for example 275,000 lbs., in either the forward or backward direction. The ram will exert compressive force toward the highwall 13 to drive the cutting head module 24 into the seam 12 either directly or through an intervening multi-section pushbeam string 27. The head 26 will also operate in reverse to pull the module 24 any pushbeam string 27 from the highwall 13.

An important part of the mining machine 10 is the multi-section pushbeam string 27. The pushbeam string 27 and the cutter head module 24 make up the portion 23 of the machine 10 which enters the mined hole 16. The pushbeam string 27 includes a plurality of identical pushbeam sections 28 each of which carries, at each end, means for securing each section of the pushbeam 28 to an adjacent pushbeam 28, to the rearward end of the cutter head module 24 or to the forward end of the ram of the power head 26. In transverse cross-section, each of the pushbeam sections 28 is a box-like column similar to that of the rear section 30 of the cutter head module 24 housing within it the forwardmost section of a horizontal auger conveyor 31 (FIG. 2) which is extended through the additional pushbeams 28. The rearmost pushbeam section 28 or, if none, cutter head module 20, engages the ram of the power head 26. The power head 26 supports motors and gearboxes which drivably engage the rearmost end of the conveyor 31 to drive it at 31 rpm. Each beam section 28 has a housing 32 which forms one section of a compressive column extending from the housing 33 of the cutter head module 24 to the driving ram of the power head module 26. The horizontal auger conveyor 31 extends the entire length of the pushbeam 27 from the rear section 30 of the cutter head module 24 to the power head 26. The power head 26 carries auger driving means (not shown) which engage and rotate the augers of the horizontal auger conveyor 31.

The ram or power head thrusting means of the power head 26 operates to drive the pushbeam 27 inwardly into the coal seam 12 from along the frame 20 thus exerting force to push a cutter drum 34 of cutter head module 24 against the forward face of the coal seam 12. This force enables the cutter drum 34 to mine coal and to cut the mined hole 16 into the coal seam 12. This cutting operation advances the module 24 and the entire assembled pushbeam string 27 into the mined hole 16. Each time the cutter head module 24 advances the length of one pushbeam 28 into the coal seam 12, the drive means on the power head 26 is disconnected from the cutter string and retracts to allow the insertion of another pushbeam section 28 from a pushbeam supply stack 35 onto the frame 20 rearward of the last pushbeam section 28, or, if none, the cutter head module 24.

The loading is accomplished with a pushbeam transfer mechanism 36 which includes a hydraulically operated table and swingarm which receives or delivers pushbeam sections 28 from a loader 37 which transfers the sections 28 between the stack 35 and the transfer mechanism 36. The transfer of pushbeam sections 28 from the stack 35 to and from the mechanism 36 is accomplished through the use of the loader 37 situated on the bench 11.

In operation, the mining machine 10 will have advanced the cutter head module 24 to its maximum practical distance into the coal seam 12 before the ram of the power head 26 then must reverse to withdraw the cutter string 23, including the pushbeam string 27 and cutter head module 24, from the mined hole 16. During the advance of the equipment into the seam 12, mined coal is constantly conveyed to the surface 11 through the conveyor 31. This coal is discharged at the power head end of the pushbeam string 27 through a discharge mechanism (not shown) to a loading system (not shown) from which it is ultimately transferred onto the ground or into trucks or other coal hauling equipment which will remove the coal from the mining site.

The removal of the cutter string 23 from a mined hole 16 proceeds by a withdrawal of the pushbeam string 27 from the hole 16 by the removal, one at a time, of each of the pushbeam sections 28, and then ultimately the removal of the cutter head module 24. When this has been achieved, the machine 10 is moved by operation of the drive system 21 in the direction 38 on the bench 11 across the face of the outcrop 14 of the highwall 13. The process is then repeated so that another mined hole is begun parallel to, adjacent to, and spaced, from the previously completed mined hole 16*a*.

As a result, a series of mine holes 16, 16*a*, 16*b*, etc. will have been left in the coal seam 12. Each of these holes 16 is separated by a rib or block 39 which supports the remaining overburden 15. The rib 39 will be typically three or four feet wide, but may be of any width sufficient to support the overburden, but not unnecessarily thick so as to leave excessive unmined coal. The mining process continues until the maximum amount of coal has been withdrawn.

Figure 2:
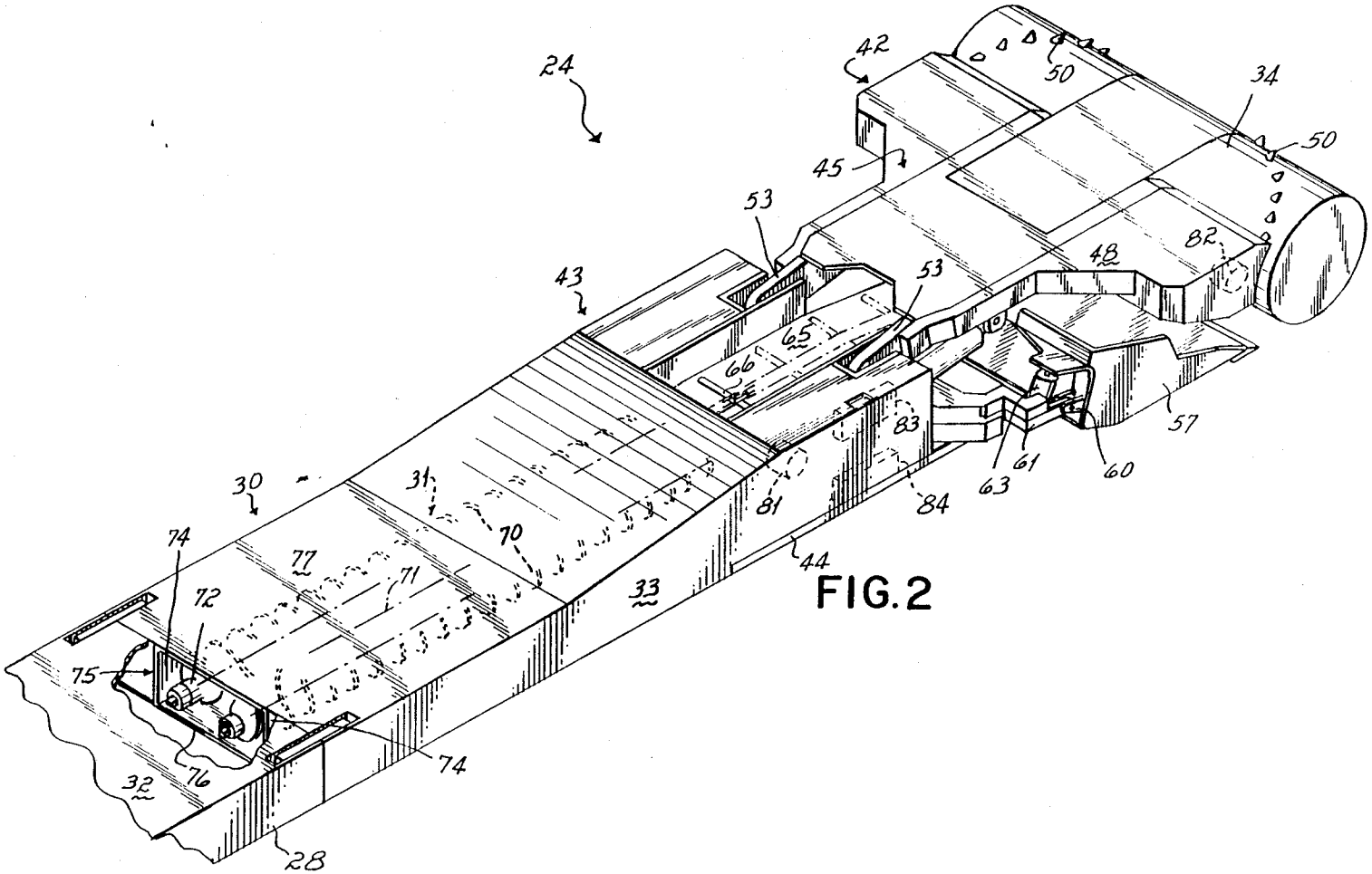
FIG. 2 is a perspective drawing illustrating more particularly the cutter head and related components of a highwall mining machine.
Figure 3:
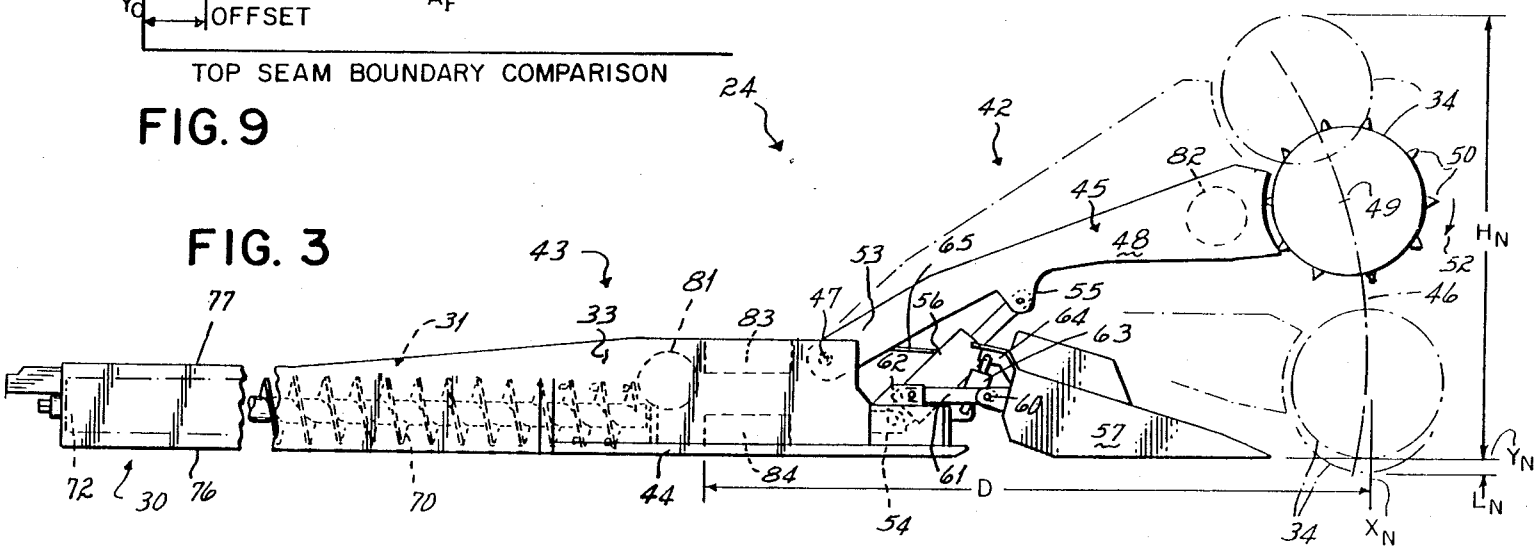
FIG. 3 is a side elevational view of the cutter head of a highwall mining machine illustrating the sensors and position indicator transducers.

Referring to FIGS. 2–3, a cutter head module 24 of the thin seam mining machine 10 is illustrated. The cutter head module 24 is the forwardmost of several modules which make up a thin seam mining machine. The module 24 includes a front portion 42, a midportion 43 and the rear portion 30. The front, middle and rear portions 42, 43 and 30, respectively, of the cutter head module 24 are joined together by a rigid steel frame 44.

The front portion 42 of the cutter head module 24 includes a cutter boom assembly 45 which may be generally of a type employed in any one of several conventional continuous mining machines. The cutter boom assembly 45 of the illustrated embodiment is pivotally attached to the frame 44 so as to move in an arc 46 in a vertical plane about a horizontal transversely disposed axis 47 at one end of a boom arm 48. Mounted to the cutter boom assembly 45, so as to pivot about a horizontal transverse axis 49 at the free end of the boom arm 48, is the cylindrical cutter drum 34. The cylindrical surface of the cutter drum 34 carries a plurality of cutter bits 50 which are arranged in a pattern to efficiently cut coal from the face as the drum 34 rotates.

The cutter boom arm 48 is a forked arm which includes a pair of arm sections 53, 53 spaced on opposite sides of the frame 44 to pivot on the frame about the axis 47. Below each one of the cutter boom arm sections 53 is a respective one of a pair of brackets 54, 54 each rigidly extending from the frame 44. A further pair of brackets 55, 55 are formed on the underside of the cutter boom arm assembly 48 one on each of the arm sections 53. Connected between each of pairs of brackets 54 and 55 is a hydraulic piston assembly 56 having a cylinder end pivotally connected to the bracket 54 on the frame 44, and having a piston rod pivotally linked to the bracket 55. The hydraulic piston 56 operates to raise and lower the cutter boom arm 48 to pivot it about the axis 47 to thereby raise and lower the cutter drum 34 along the arc 46.

The cutter head boom assembly 45 and the related components of the front portion 42 of the cutter head module 24 function in the same manner as the cutter head on a conventional continuous mining machine. A number of different cutter head configurations are used with thin seam mining machines of the type to which the present invention relates. The particular configuration most suitable for a given application is determined by a number of factors, one of which is the thickness of the coal seam and the appropriate width of the mined hole to be cut. Some such cutter heads are hydraulically driven and others are electrically driven. Based on present technology, the larger cutter heads are of the electrically driven type due to their ability to develop greater torque and power while the smaller heads are often of the hydraulically driven type due to their ability to develop adequate power in a more confined space. One of the electric type known in the art is manufactured by Joy Manufacturing Company as Joy Model 14CM.

Such a cutter boom assembly 24 includes an electrical cutter drum drive (not shown) contained within the cutter head assembly 45 which rotates the drum 34 in the direction 52 to cut coal from the face of the seam as the drum 34 advances into the coal seam. Coal, when mined, drops beneath the drum 34 to the floor of the mined hole at the base of the leading forward wall of a mined hole which is being cut by the drum 34. The mined coal which drops to the floor of the mined hole beneath the cutter drum 34 is gathered by a gathering head or gathering pan 57. The gathering head assembly 57 is pivotally connected about a horizontal transverse shaft 60 at its rear end to linkage 61 which is in turn pivotally linked to a bracket 62 on the frame 44. The weight of gathering pan 57 is pivotally supported away from the floor of the mined hole by a gas spring assembly 63 connected between the frame 44 and a link 64 at the upper rear end of the gathering pan 57. The amount of support is varied to permit proper cleanup without excessively digging into the mined floor. The gathering pan 57 is a conventional type having gathering arms (not shown) therein which gather the coal onto the pan 57 and advance it to a gathering conveyor 65 of the endless chain type which moves the mined coal rearwardly between the arm sections 53 of the cutter boom arm assembly 48 from the forward portion 42 of the cutter head module 24 to the midportion 43 thereof.

At the midportion 43 of the cutter head module 24, the endless conveyor belt of the gathering conveyor 65 is driven by conveyor drive means (not shown) which includes foot shaft located in the gathering head drivably connected between drives for each of the gathering arms which drives the conveyor, transmits power between the gathering arms and synchronizes the two arms. The conveyor 65 is an endless chain having a plurality of transverse bars 66 attached thereon for advancing the coal rearwardly from the forward section 42 of the module 24 to the midsection 43 as the conveyor 65 is driven. The conveyor 65 delivers the mined coal to the forwardmost portion of an auger type material removal conveyor 31 which extends through the pushbeam string 27 beyond the surface of the highwall 13.

Referring also to FIG. 3, the conveyor 31 includes a pair of multi-section counter-rotating and counter-spiraled augers 70, the forwardmost sections of which are housed within the rearward section 30 of the module 24 and supported at their forward ends by bearing assemblies (not shown) carried by the frame 44. This rearmost section 30 of the cutter head module 24 joins the forwardmost section of the pushbeam assembly 27 (FIG. 1) which functions to transfer to the cutter head module 24 the force to advance it into and withdraw it from the mined hole as developed by power head 26.

Referring to FIG. 2, the augers 70 of the conveyor 31 are symmetrically positioned on opposite sides of a center line 71 of a forward beam housing section 33. Referring again to FIG. 3, the housing section 33 has a rectangular cross-section and rigidly connected to the frame 44. The forward section of the auger conveyor 31 extends longitudinally from its forward end through the housing 33 to drivably connect at its rearward end 72 to the section of the auger conveyor within the next successive beam module 28. The augers 70 are also supported to the housing 33 near the rear end 72 thereof by bearings (not shown) carried by the housing 33.

The housing 33 encloses the conveyor 31 at the rear section 30 of the module 24. Referring to FIG. 2, the housing 33 has a pair of vertical inner walls 74 spaced on each side of the augers 70 which form a rectangular channel 75 about the augers 70 in cooperation with a lower housing surface or plate 76 and an upper housing surface or plate 77. Both of the augers 70 rotate upwardly along the centerline 71 of the seam sections.

During the mining of coal, the gathering conveyor 65 delivers and deposits the coal from the cutter head onto the forward end of the horizontal auger conveyor 31 in the vicinity of the front ends of the augers 70 from where the coal is transported by the rotation of the augers through the rectangular channel 75 to the surface of the mined hole.

The external walls of the housing 33 have a smooth and regular shape. This facilitates the removal of the mining machine cutter head module 24 from the mined hole.

Referring further to FIGS. 2 and 3, a cutter head inclinometer 81 is provided to measure the angle of inclination of the longitudinal axis of the cutter head with respect to the horizontal. This inclinometer 81 is a pendulum-type inclinometer which is responsive to the gravity vector to drive a rotary potentiometer having a range for example 0 to 10,000 ohms which will deliver a signal proportional to the measured angle. The inclinometer 81 has a housing mounted to the inside of the wall 33 of the middle section 43 of the cutter head 24. A second pendulum-type inclinometer 82 is mounted on the inside of the cover of the cutter boom arm 48. The inclinometer 82 measures the angle of the axis of the arm 48 of the boom 45 with respect to the horizontal plane. It similarly delivers an electrical signal representative of this angle.

Referring to FIG. 3, mounted on the interior of the cutter head 24 a distance D behind the cutter drum 30 are a pair of gamma radiation detectors including a first gamma radiation detector 83 and a second gamma radiation detector 84. The detector 83 is positioned at the top of the housing 33 of the cutter head 24 and is upwardly directed to measure, through a suitable aperture, natural radiation incident upon the detector from the material above the coal seam 12. This sensor 83 generates an electrical output signal which is related to the thickness of the coal remaining between the rock overlying the coal seam and the roof of the mined hole. The natural gamma radiation from the rock is attenuated by the coal. The attenuated signal from the detector 83 is compared with a calibrated standard value of the radiation level of the exposed rock to produce a signal representative of coal thickness remaining after the hole is cut. The second detector 84, similar to gamma radiation sensor 83, is mounted on the bottom of the cutter head assembly to similarly measure, through an aperture (not shown), the thickness of the coal underlying the mined hole between the rock and the floor of the mined hole.

The geometric analysis of the highwall mining operation will be facilitated by defining certain variables for the geometry of the cutter head as shown in FIG. 3. For discussion of the analysis, the following variables will be defined.

A = top seam elevation
B = bottom of seam elevation
C = cutter boom elevational angle
D = displacement of sensors behind cutter drum
DX = increment of hole depth
DY = increment of hole elevation
E = coal production rate F = bottom coal thickness
G = bottom of cut elevation
H = top shear height
K = coal density
L = bottom shear height
N = increment
P = mined coal weight
Q = cutter head angle
R = top coal thickness
S = hole cross-sectional area
T = time
U = mined hole height
V = mined coal volume
W = hole width
X = entry depth
XT = top sump depth at cut
XB = bottom sump depth at cut
Y = cutter head reference elevation
Z = top of cut elevation It should be appreciated that the hole elevation need not be accurately measured, but only mapped in accordance with relative values. Thus, the elevation of the seam may not, and need not, according to the values calculated, accurately represent the elevation of the hole or seam boundary within the earth. For example, assuming that the angle Q equals its tangent, or that the hypotenuse or hole length represents the horizontal X-axis, while not depicting actual position, yields repeatable values which are valid for comparison with adjacent holes. In addition, the resulting measurements are related to the known equipment dimensions rather than calculated values, providing reliability in the data on which the computations are based. First, it should be appreciated that it is the cutter head drum 34, and more specifically the leading cutting face of the drum 34 which defines the surface of the hole being cut. The drum 34 will have a nominal diameter of, for example, thirty-four inches. This dimension is small in relation to the depth of the mined hole which may be approximately 400 feet. Thus, the hole depth will be measured, arbitrarily, from the entrance of the mined hole along the curve of the hole to the axis 49 of the drum 34. This distance is assigned the variable $X_N$. The sensors 83 and 84 are positioned a distance D behind $X_N$ so that they measure the coal thickness at hole depth ($X_N$—D). The hole elevation $Y_N$ at depth $X_N$ is defined as the elevation above (or below) the elevation at the floor of the hole at the entrance to the hole at the highwall which is at depth $X_O$ at elevation $Y_O$, which both equal zero. $Y_N$ will lie on the plane of the base of the cutter head 24 at a point where the lower surface of the drum 34 would touch that plane. $Y_N$ is independent of the position of the cutter drum 34 or the actual hole boundaries.

Referring concurrently to FIGS. 3 and 4 will facilitate understanding of these variables. $Q_O$ is the angle of inclination of the cutter head 24 as it starts into the hole 16 at point ($X_O$,$Y_O$) at the face of the highwall 13. $Q_N$ is the angle of inclination of the cutter head 24 at mining level ($X_N$, $Y_N$).

The upper cutting surface of cutter drum 34, when at its maximum predetermined extent, is defined as the top shear height $H_N$. It is measured in inches above the base plane of the cutter head at point ($X_N$, $Y_N$). The bottom shear height $L_N$ is similarly the lowest cutting point of the drum 34 which may be above (positive) or below (negative) $Y_N$.

Figure 5:
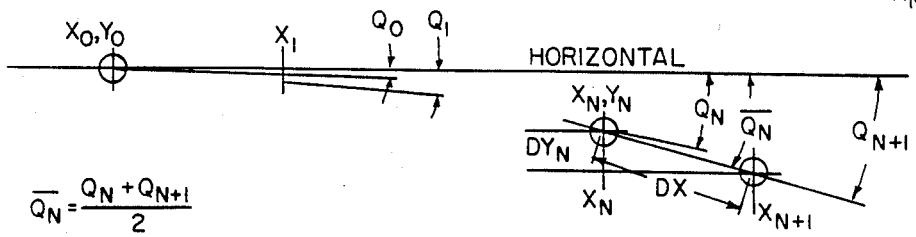
Figure 5A:
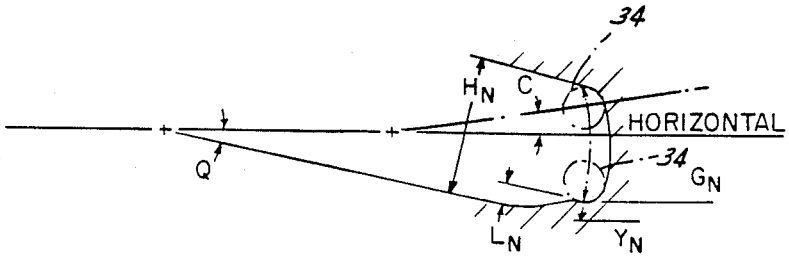
Figure 5B:
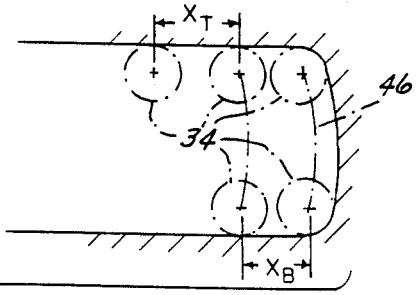

The mathematical representation of the measured geometric values and of the computed geometric values is illustrated in FIGS. 5–5B. The computations are performed by a computer having an 8088 microprocessor contained in the operator compartment at the power head.

Referring to FIG. 5, the first calculated value, and the measured absolute dimensions, are defined with respect to the point of reference $X_OY_O$ on the floor of the mined hole at its intersection with the highwall. The control program calculates values reference part $X_NY_N$ at each interval N along the floor of the mined hole. The function $Y_N$ is thus the elevation of a point on the line formed by the intersection of the plane of the bottom of the cutter head module 24 and the bottom surface of the cutter drum 34. A point ahead of the cutter head 24 in the plane of its lower surface 76 at the position $X_N$ along the length of the mined hole. It has been found preferably to use increments of hole length rather than horizontal distances as the independent variable over which the elevation of the hole is measured for storing and plotting of data. The elevation measurements will be taken at increments DX which are preferably equal to a value of approximately 2 feet, but may be of any value. As a result, the elevation is measured at the lengths $X_1$, $X_2$, $X_3$, . . . along the length of the mined hole. The measurements of elevation $Y_N$ are taken at the increments DX along the hole length by periodic readings from the output of the inclinometer 81. Preferably, one reading is taken at each increment and an average of the two readings is used as the slope of the intervening increment. As illustrated in FIG. 5, the change in elevation is thus equal to the increment of length DX times a tangent of the angle of inclination of the hole at the point of the measurement. The elevation $Y_N$ of the mined hole at point $X_N$ will equal the sum of the elevational changes for each of the increments from the entrance of the hole at $X_OY_O$ to the point of measurement $X_NY_N$. This number $Y_N$ plotted over the hole depth $X_N$ is the reference point for which the values which are to be.

The heights of the cut roof and floor of mined hole above the reference point $Y_N$ in a direction perpendicular to the plane of the cutter head 24 are defined, according to the preferred embodiment of the invention, as the top mining height $H_N$ and bottom mining height $L_N$, respectively. These are the respective upper and lower cutting surfaces of the cutter drum 34 at the maximum upward and downward extent of the cutter drum 34. This figure is calculated from the measured value for the angle C which is output from the inclinometer 82 on the cutter arm 48, from which is subtracted the measured value for the angle Q which is output from the inclinometer 81 on the cutter head 24. This calculation will be particular to the specific structure of the cutter head and the size of the drum being used. Generally, the radius of the drum, the length of the arm, and the position of the hinge point of the arm with the cutter head are taken into account and simple trigonometric calculations will be employed. The important thing, however, with the illustrated embodiment, is that a linear value is produced representative of the height $H_N$ representing the distance of the upper cut interface from the reference $Y_N$, with $H_N$ being defined as the top shear height. Thus, the elevation of the top of the cut, or the roof of the hole, $Z_N$ equals the sum of $Y_N$ and $H_N$. Similarly, the bottom shear height $L_N$ is the distance above or below the reference $Y_N$ at which the cutter interface cuts. A positive figure for $L_N$ indicates that the cut is being made such that the hole will be ascending while a negative $L_N$ represents a descending hole or hole of negative slope. The elevation of the hole floor $G_N$ is thus equal to the sum of $Y_N$ and $L_N$. The values of $Z_N$ and $G_N$ are stored and plotted as the contour of the mined hole at $X_N$ along the length of the hole.

The difference between $H_N$ and $L_N$ is thus the cut height of the hole $U_N$. The width of the hole is known width W of the cutter drum 34. The cross sectional area $S_N$ of the cut hole at the point $X_N$ in the hole can be computed. This figure multiplied by DN represents the volume of coal $V_N$ mined during the increment $DX_N$. The density of the coal K will also be a known number. Accordingly, the coal tonnage $P_N$ mined from the hole up to point $X_N$ is calculated. From the known rate at which the mining machine proceeded through the distance $DX_N$, the rate at which the coal is mined is calculated. The rate $R_N$ representing the rate at which coal is being mined at any point along the mined hole is a calculated value which is output by the system for storage, programmed adjustment of parameters, and display to the operator for his use in control of the machine.

Referring to FIG. 5B, the forward progress of the cutter drum 34 into the hole is measured by the average advancing speed of the pushbeam column as controlled at the bench by the movement of the power head ram which drives the pushbeams and averaged over a mining cycle as illustrated in FIG. 5B. The programmed settings on the operator's panel which affect the cycle are shown in FIG. 6.

The mining cycle includes, for example, the "sumping-in" of the cutter as when the cutter drum 34 is at the maximum upward position and essentially has attained the top shear height $H_N$ at its uppermost point. If this point is taken as the beginning of the cutting cycle, there are four motions through which the cycle will proceed. The first motion, or the "sumping-in" motion, occurs as the power head drives the column forward a specified sump depth known as the top sump depth $DX_T$ at a given rate or sump speed. The next motion is the "shear-down" motion which occurs when the power head ram has stopped and the drum 34 is moved by the downward pivoting of the cutter arm 48 to the point where the cutter drum 34 is at its lowest extent at the bottom shear height $L_N$. The change in cutting heights between the beginning and end of this shearing down motion is the downward shear angle and proceeds at a rate transverse the hole with the advancing progress into the hole being thus 0. The third motion is the forward advancing of the cutter into the seam at the bottom position adjacent $L_N$. This proceeds a distance referred to as the bottom sump depth or $X_B$ which proceeds at a predetermined rate. This is followed by the shearing upward motion at which the cutter again moves upwardly cutting coal as the cutter advances to the top shear height again to begin the next cycle. The total time for this cycle $T_C$ divided into the sum of the top and bottom sump depths $(X_T+X_B)$ equals the average forward rate of the mining operation. This total sumping in distance constitutes the distance traveled linearly during the cycle time $T_C$ and provides a basis for calculating the time $T_N$ for the forward progress through the distance $DX_N$. This accordingly provides a basis for computing the rate of mined coal $E_N$ as equal to the volume $V_N$ divided by the time $T_N$.

Referring to FIG. 6 a display panel and keypad used for controlling the parameters of the highwall mining machine which are relevant to the present invention are diagrammatically illustrated. The controls which effect the cutting of the boundaries of the mined hole are the drive for the power head ram which influences the longitudinal advancement of the cutter head into the seam, and the cutter boom drive which controls the transverse vertical displacement of the cutter drum which effects the height of the mined hole. It should be noted that the top shear height effects the upper boundary of the mined hole and the amount of coal being mined as well as the amount of coal which will be left at the roof of the mined hole. The bottom shear height however in addition to affecting the amount of coal mined and the amount of coal remaining at the bottom of the seam also serves as the mechanism for controlling the inclination angle of the cutter head and determines whether the cutter head 24 will move upwardly or downwardly as it progresses forwardly into the seam.

As illustrated in FIG. 6, the parameters which control the advancement of the ram, namely, the top and bottom sump depth and speed settings are displayed for the operator. The top and bottom sump depth settings are the lengths $X_T$ and $X_B$ through which the ram will advance the cutter head when the cutter is at the top and bottom respectively of the cutter boom maximum and minimum height settings. The sump speed settings are the respective settings which determine the rate at which the top and bottom sump depths are respectively cut by the advancement of the power head ram.

The sump depth and speed settings are preferably preset by the operator and are readjusted as the miner advances into the coal. It is anticipated that the presetting or adjustments may be carried out in part at least by a program.

Similarly, the shear height at the top and the bottom are assigned maximum program settings and the speed for shearing upwardly and downwardly is also set by program values. All of the values for the power head ram drive and the cutter boom drive are also displayed in response to actual feedback from transducers in the mining machine so that the operator is aware of what values are actually being achieved. With respect to the maximum sump depths and shear heights however the drive will continue until the maximum programmed value is achieved.

The sump and shear values discussed above may be modified at any time by the operator through the use of a keypad by selecting a variable through an appropriate entry and then modifying the variable by entry of the new value for that variable. Once such changes are made, the mining machine will then proceed to operate from that point forward in accordance with the new settings.

Figure 7:
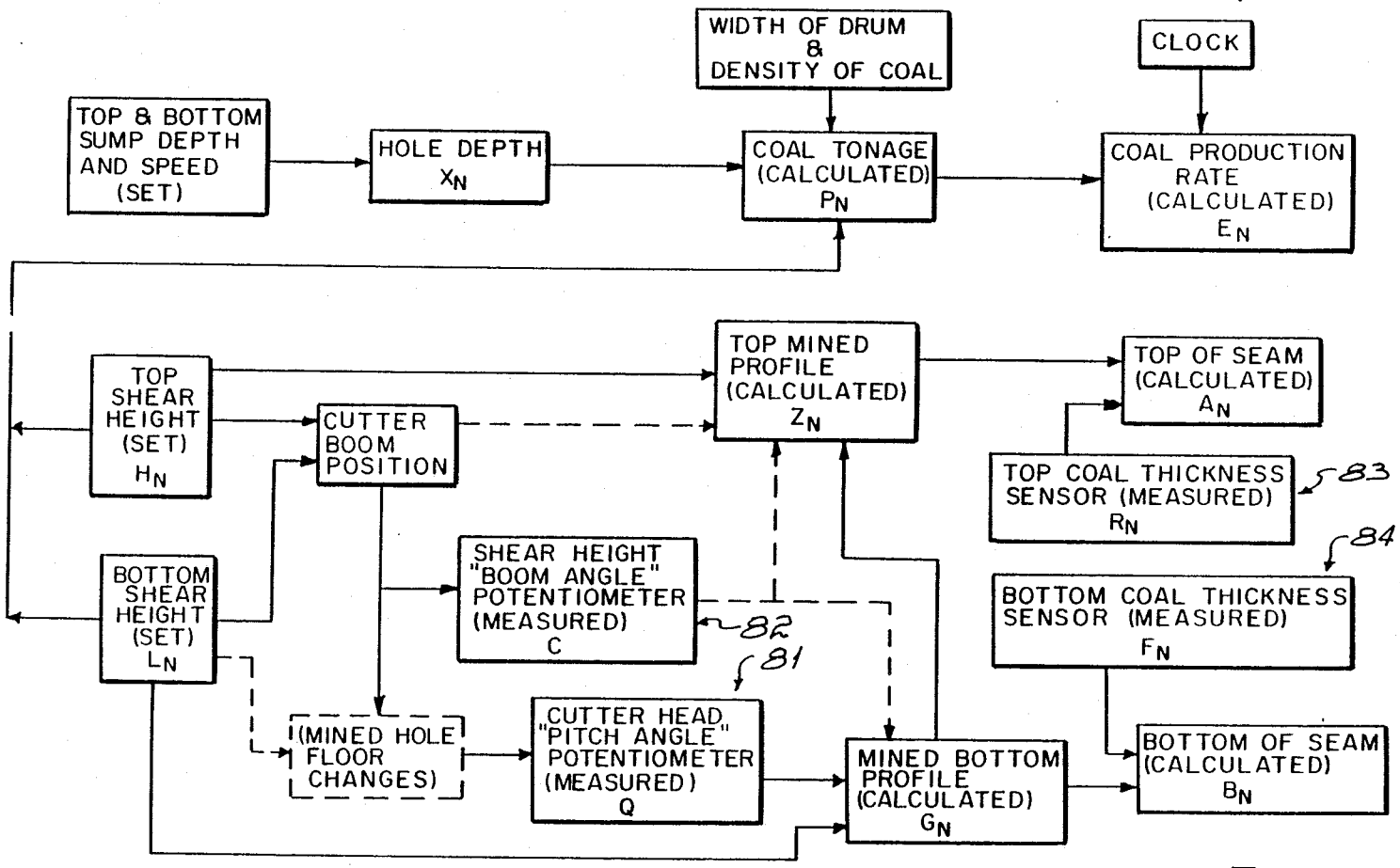
FIGS. 7 and 7A are flowcharts and information block diagrams illustrating the logic of the information processing components of the controls of the machine of FIG. 1.

Referring now to FIG. 7, an information flow block diagram is illustrated. At the left of FIG. 7, the values entered from the panel illustrated in FIG. 6 are shown. These are the values which enter the program operation of the machine primarily through operator entry. These values may also be programmed on the basis of a prior stored contour of the seam where predicted seam contour and resulting program for the mining of the current mined hole.

Additional values shown in FIG. 7 include those entered from the sensors in the mining machine. Particularly, these include the cutter head pitch angle $Q_N$ from potentiometer 81 and the cutter boom angle C from the shear height potentiometer 82, as well as the gamma radiation detectors 83 and 84 or by some other coal thickness sensor, which measure the top and bottom remaining coal thicknesses $R_N$ and $F_N$, respectively. These values are added to the mined hole top and bottom $Z_N$ and $G_N$ respectively to arrive at top and bottom seam elevations $A_N$ and $B_N$ respectively.

The top and bottom sump depth and speed controls basically drive the ram of the power head and determine the hole depth represented by variable $X_N$. The top and bottom shear height controls drive the cutter boom to its various positions and determine the maximum upward and downward extent of the cutter boom. This will affect the shear height angle as measured by the shear height angle potentiometer 82. The shear height angle potentiometer output is however used primarily for feedback control. In that the shear height will move to the maximum settings and then stop, the program settings are used in the calculations rather than the feedback from the potentiometer 82. Accordingly, the shear height angle potentiometer output could be used for these computations and that is illustrated by dotted lines in FIG. 7. The preferred flow of information by the calculations is however illustrated by the solid lines in the figure. The cutter head pitch angle potentiometer however is provided to derive the information for computing the mined hole reference point $X_NY_N$. This figure is further combined with the top shear height setting to compute the top mined hole profile. The mined hole profiles are then further combined with information from the coal thickness sensors 83 and 84 to produce the calculation for the top and bottom coal seam elevations $A_N$ and $B_N$ respectively. These then may be combined with the hole dimension data in the vertical direction to compute the recovery percentage of the coal.

The programmed top and bottom shear height settings are further combined with the hole depth figure to compute the coal tonnage mined. This calculated value is correlated with the output of a clock to produce an output of the coal production rate. These figures are all displayed so that the operator can modify the programmed operation of the mining machine in such a way to optimize production. This data is also stored so that plots or maps will be generated therefrom for the information of the operator during the mining of the current hole and also for future display to the operator and for programmed use by the operator in modifying and setting the program for the operation of the mining machine during the subsequent mined hole operation.

Figure 7A:
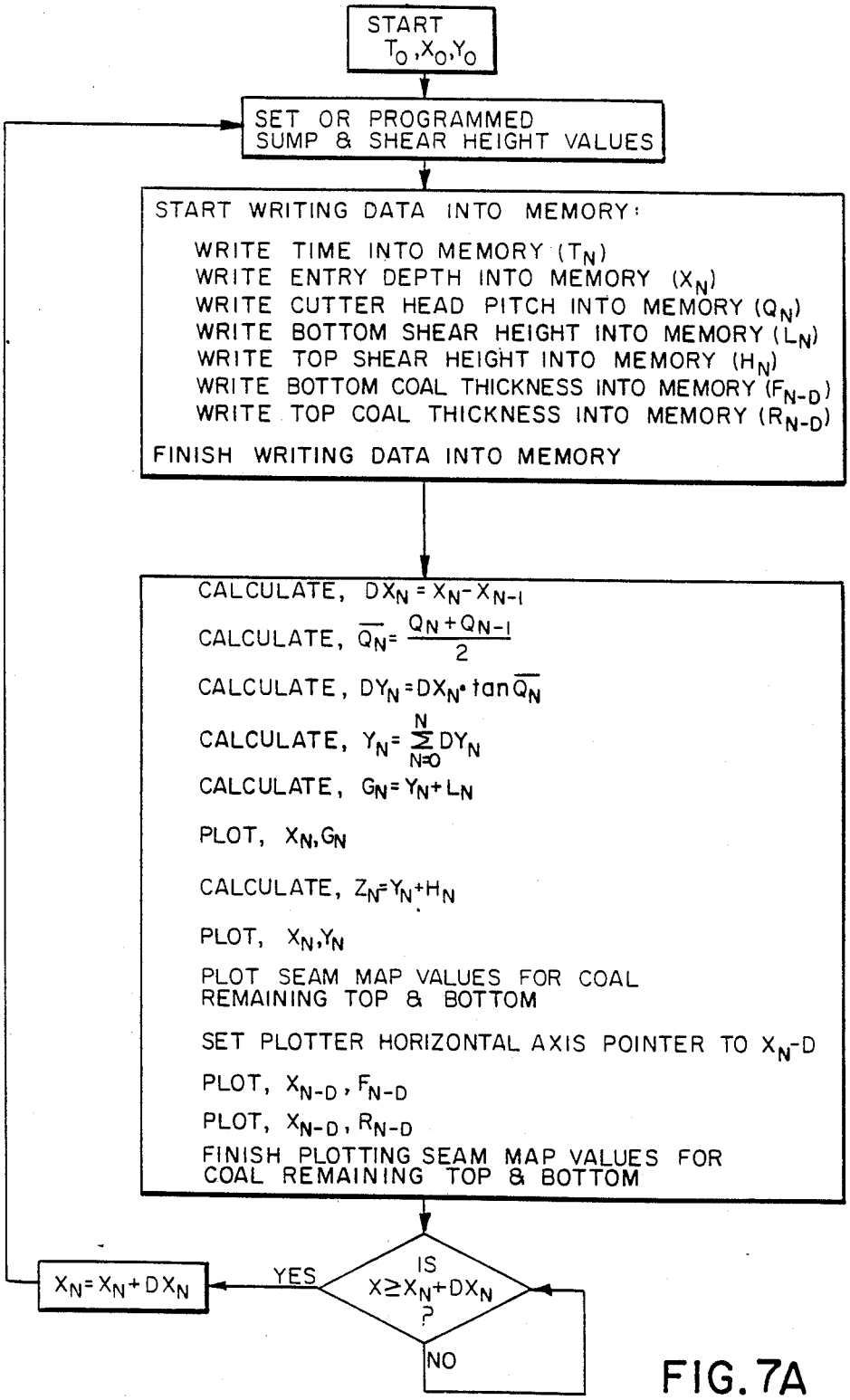

With respect to FIG. 7A, the calculations of the values in accordance with the information flowchart of FIG. 7 are illustrated in a simplified flowchart form describing the sequence of computation in the various equations and information processing steps employed.

Figure 8:
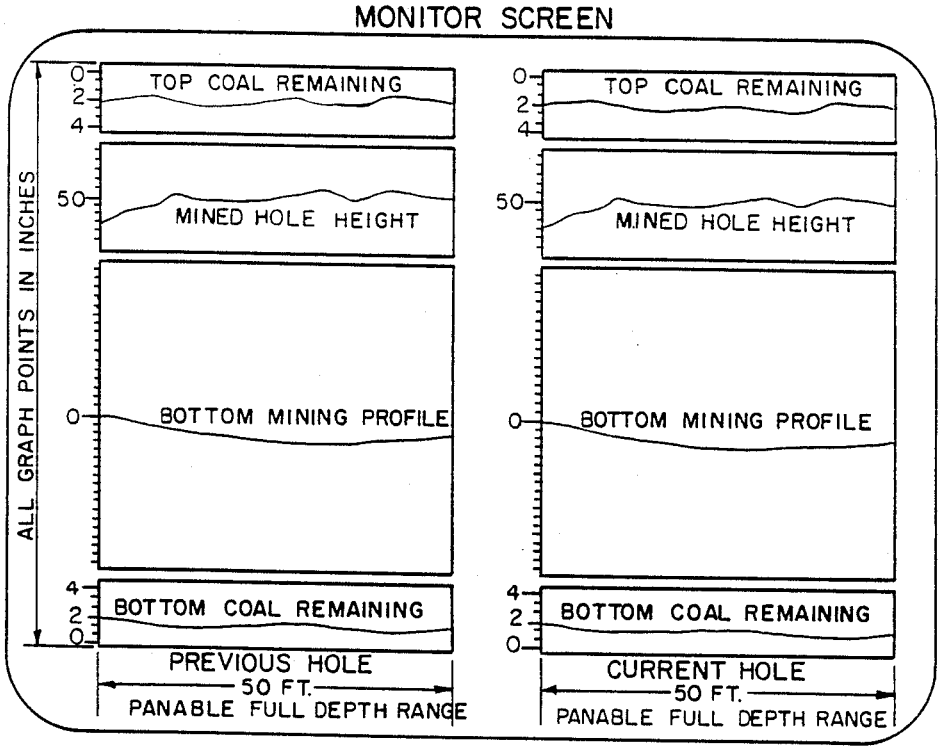
FIGS. 8 and 8A are diagrams illustrating the graphical displays of the map outputs according to principles of the present invention.

In FIG. 8, the displays produced by one embodiment of the invention are illustrated in graphical form the bottom mining profile and the top mining profile which are the upper and lower ceilings of the mined hole are displayed. The bottom mining profile is measured as a number of inches above or below the elevation of the entry point of the mined hole at $X_0Y_0$. The height of the coal mined is the distance in inches of the roof of the mined hole from the bottom of the mined hole as plotted in the bottom mining profile curve. The top coal remaining and bottom coal remaining are also plotted. This plotting is delayed in real time to compensate for the rearward displacement D of the sensors 83 and 84 from the cutting edge of the cutting head at point $X_N$.

Figure 9:
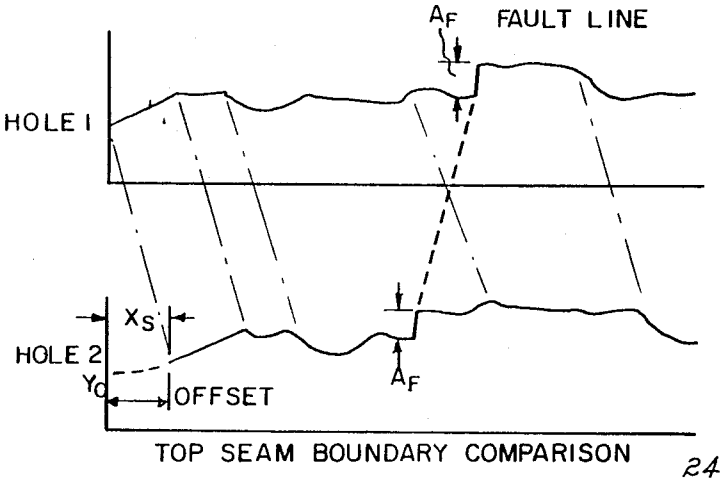
FIG. 9 is a diagram illustrating the relationship of sample data with respect to a previous fully mined and currently mined hole in a coal seam.
Figure 8A:
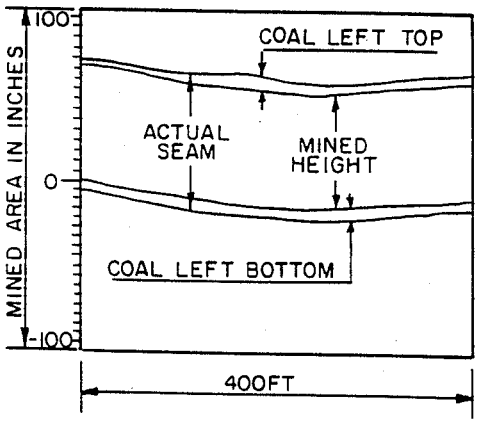

The plot of the current mined hole and of the previously mined hole are illustrated so that they can be compared by the operator. In the embodiment shown in FIG. 8, these are illustrated side by side but they may be illustrated in another manner to differently display to the operator the relationship between the curves of the two holes. For example, FIG. 8A illustrates a composite of the information for a given mined hole. The information in FIG. 8A is a composite of information from FIG. 8 from either the current or previous hole or any other hole. Such a display may be called up from memory by the operator at any time. FIG. 9, on the other hand, shows a display of a combined computation of the top plane height and the top coal remaining to produce a profile of the top of the coal seam. A similar profile may be generated for the bottom of the coal seam. As FIG. 9 illustrates, the curves have a similar shape but that one is offset in the longitudinal direction with respect to the other indicating that $X_N$ for one hole will equal or correspond to $X_N$ plus a constant $X_S$ for the next hole. These are illustrated by the parallel diagonal lines connecting the relative points on the two graphs of FIG. 9.

In addition, in FIG. 9, a sample showing a geological fault in which the seam has shifted in the coal seam vertically a distance $A_F$ is illustrated. This fault, as indicated by the step so labeled, is not at the corresponding point in the contour of this seam ceiling but runs at an angle through the fault. This is illustrated by the line showing the shift in the fault from one mined hole to the other. In programming the mine pass for the current mined hole, the operator may make adjustments to the actual parameters using information derived from the previously mined hole in order to set the values on the panel shown in FIG. 6. This may be done in all or at least in part automatically through the use of algorithms which estimate and predict the values from one hole to the other. However, it has been found that due to the complexities and inherent unpredictability of the profiles of coal seams when moving away from the areas where the data was previously gathered, operator ability to readily perceive the data, to interpret the incoming data from the currently mined hole, and to make manual adjustments to the programmed settings will result in better use of the equipment and more efficient production of the coal. This is particularly found to be the case where the equipment operators have substantial acquired experience in operating the equipment and have considerable knowledge regarding the configuration of coal seams in a particular area of the United States. With less experienced operators and with more sophisticated geological measuring techniques, a greater dependence on automated presetting of the program may expectedly be employed.

It should be noted that the plot in FIG. 8A is illustrated for the entire depth of a mined hole from $X_0$ to $X_N$=400 feet. It is found more useful for the immediate operation of the machine, to display for the operator, as is illustrated in FIG. 8, portions of the graph for approximately 50 feet of mined hole and 50 feet of corresponding portion of a previously mined hole side by side for the operator. This will enable the operator better to relate the information from the previous hole to the decisions made in operating the equipment for the mining of the current hole.

In addition to employment of the coal thickness sensors 83 and 84, other means in addition or in the alternative to the use of such sensors is employed to insure that the cutter does not cut beyond the boundary of the coal seam. Specifically, current monitoring devices are employed to signal abnormal changes in the power to the cutter drum. Were the cutter head hydraulically rather than electrically driven, a fluid pressure monitor would be employed for a similar purpose. A signal from these sensors will, in the majority of cases where the rock adjacent the sensor is harder than the coal, produce an electrical signal whenever the cutter drum cuts into the harder rock. This signal may be programmed to record the position of the seam boundary. Preferably, this signal is used in addition to, rather than in lieu of the signal from sensors 83 and 84. Sensors 83 and 84 have the advantage of not only sensing proximity to the seam boundary, but sensing the thickness of the coal between the hole and the boundary. The sensors 83 and 84, however, cannot be easily positioned at the cutter drum. Thus, their signals represent a thickness of coal some distance D behind the point of cut. The current or drum drive power sensing technique presents a signal indicating the coal thickness of zero at the point of cut. Thus, in combination, the information delivered by both techniques is better than by either alone.

The natural gamma radiation sensors may, in some coal seams, be less desirable than backscatter radiation detectors, RF conductivity detectors, or other coal thickness sensors known in the art. This is because not all rock types produce adequate natural gamma radiation or radiation which is uniform across the boundary of the seam. For many applications, gamma radiation sensors are preferable. One suitable type are those manufactured by Salford Electric, Ltd. of London, England.

We claim:

1. A method of controlling the operating efficiency of a highwall mining machine having a power head located on a bench adjacent the highwall, a cutter head operable to cut a mined hole into a coal seam when thrust thereagainst, and a compression beam extending between the power head and the cutter head for thrusting the cutter head forward against the seam with force delivered by the power head, said cutter head having a cutter controllably moveable thereon for cutting the boundary of the hole in a selected direction relative to the position of the cutter head, the thrusting by the power head and the movement of the cutter being controllable by a human operator from the bench; said method comprising the steps of:

sequentially mining a plurality of holes into a coal seam with a highwall mining machine by thrusting the cutter head with the power head through said compression beam against the coal seam and moving said cutter with respect to said cutter head;

repeatedly measuring the position of the boundary of the mined hole along its length as each of said plurality of holes is being mined;

storing data from said boundary position measurements in a data processing storage medium;

repeatedly measuring the thickness of the coal adjacent the boundary of each of said plurality mined holes along its length as each of said plurality of holes is being mined;

storing data from said coal thickness measurements in a data processing storage medium;

graphically displaying to the operator, from the stored boundary data, a map of the mined hole as it is being mined;

graphically displaying to the operator as the hole is being mined, from the stored coal thickness data, a map of the coal seam adjacent the mined hole;

graphically displaying to the operator as the hole is being mined, from boundary data stored during the mining of an adjacent previously mined hole, a map of the previously mined hole;

graphically displaying to the operator as the hole is being mined, from coal thickness data stored during the mining of an adjacent previously mined hole, a map of the coal seam adjacent the previously mined hole; and further cutting the boundary of the mined hole in response to a comparison by the operator of the graphically displayed maps.

2. The method of claim 1 wherein said hole mining step is performed by movement of said cutter head and cutter in accordance with initially preset control parameters.

3. The method of claim 2 wherein said initially preset parameters are preset by the human operator.

4. The method of claim 2 wherein said initially preset parameters are preset in response to data derived from the mining of at least one previously mined hole.

5. The method of claim 4 wherein the derived data is data from said data storing steps performed during the mining of at least one previously mined hole.

6. A method of controlling the operating efficiency of a highwall mining machine having a power head located on a bench adjacent the highwall, a cutter head operable to cut a mined hole into a coal seam when thrust thereagainst, and a compression beam extending between the power head and the cutter head for thrusting the cutter head forward against the seam with force delivered by the power head, said cutter head having a cutter controllably moveable thereon for cutting the boundary of the hole in a selected direction relative to the position of the cutter head; said method comprising the steps of:

sequentially mining a plurality of holes into a coal seam with a highwall mining machine by thrusting said cutter head against the coal seam through said compression beam and moving said cutter with respect to said cutter head;

repeatedly measuring the position of the boundary of the mined hole along its length as each of said plurality of holes is being mined;

storing data from said boundary position measurements in a data processing storage medium;

repeatedly measuring the thickness of the coal adjacent the boundary of each of said plurality mined holes along its length as each of said plurality of holes is being mined;

storing data from said coal thickness measurements in a data processing storage medium; and controlling the operation and movement of said cutter to shape the boundary of said hole in accordance with information derived from stored data measurements of said hole being mined and a previously mined hole.

7. The method of claim 6 wherein said hole mining step is performed by movement of said cutter head and cutter in accordance with initially preset control parameters.

8. The method of claim 7 wherein said initially preset parameters are preset by the human operator.

9. The method of claim 7 wherein said initially preset parameters are preset in response to data derived from the mining of at least one previously mined hole.

10. The method of claim 9 wherein the derived data is data from said data storing steps performed during the mining of at least one previously mined hole.

11. The method of claim 10 wherein said parameters are directly preset in accordance with a program.

12. The method of claim 7 wherein the operation and movement of said cutter and cutter head are controlled by a human operator.

13. The method of claim 12 further comprising the step of automatically setting said control parameters in accordance with a program.

14. The method of claim 6 wherein said controlling step includes the step of automatically setting control parameters in accordance with a program.

15. The method of claim 14 wherein said controlling step includes the step of varying said automatically set parameters by a human operator in response to said stored data.

16. The method of claim 14 wherein said controlling step includes the step of varying said automatically set parameters at least in part by a control program responsive to said stored data.

17. The method of claim 6 wherein said boundary position measuring step comprises:

the steps of measuring the position of the cutter head with respect to the bench and the position of the cutter with respect to the cutter head.

18. The method of claim 6 wherein said boundary position measuring step comprises:

the step measuring the orientation of the cutter head with respect to the earth.

19. The method of claim 6 wherein said boundary position measuring step comprises:

the step of integrating the measurements along the mined length of the hole to determine the position of the cutter head with respect to the bench.

20. The method of claim 6 wherein said boundary position measuring step comprises:

the steps of measuring distance of the cutter from the cutter head along a line in a vertical plane and perpendicular to the longitudinal axis of the cutter head.

21. The method of claim 6 wherein the measured thickness is taken above and below the hole.

22. The method of claim 21 wherein the thickness measurement is performed with sensors spaced behind the cutter head.

23. A method of controlling the operating efficiency of a highwall mining machine having a power head located on a bench adjacent the highwall, a cutter head operable to cut a mined hole into a coal seam when thrust thereagainst, and a compression beam extending between the power head and the cutter head for thrusting the cutter head forward against the seam with force delivered by th power head, said cutter head having a cutter controllably movable thereon for cutting the boundary of the hole in a selected direction relative to the position of the cutter head; said method comprising the steps of:

mining a hole into a coal seam with the mining machine;

repeatedly measuring the position of the boundary of the mined hole along its length as the hole is being mined;

automatically computing from data derived from the measurements the volume of coal mined from the seam; and generating an output signal representative of the amount of coal mined from the hole.

24. The method of claim 23 wherein said output generating step includes the step of displaying said signal in humanly perceivable form to a human operator of said machine.

25. The method of claim 24 wherein said signal includes information relating to the rate at which coal is being produced from the mined hole.

26. The method of claim 23 wherein said signal includes information relating to the rate at which coal is being produced from the mined hole and said method further comprises the step of controlling the further operation of the machine in response to said signal.

27. The method of claim 23 wherein said signal includes information relating to the amount of coal removed from the mined hole.

28. A method of controlling the operating efficiency of a highwall mining machine having a power head located on a bench adjacent the highwall, a cutter head operable to cut a mined hole into a coal seam when thrust thereagainst, and a compression beam extending between the power head and the cutter head for thrusting the cutter head forward against the seam with force delivered by th power head, said cutter head having a cutter controllably movable thereon for cutting the boundary of the hole in a selected direction relative to the position of the cutter head; said method comprising the steps of:

mining a hole into a coal seam with the mining machine;

repeatedly measuring the position of the boundary of the mined hole along its length as the hole is being mined;

repeatedly measuring the thickness of the coal adjacent the boundary of the mined hole along its length as the hole is being mined;

automatically computing from data derived from the measurements the volume of coal remaining in said seam;

generating an output signal representative of the amount of unmined coal left in said seam.

29. A method of controlling the operating efficiency of a highwall mining machine having a power head located on a bench adjacent the highwall, a cutter head operable to cut a mined hole into a coal seam when thrust thereagainst, and a compression beam extending between the power head and the cutter head for thrusting the cutter head forward against the seam with force delivered by the power head, said cutter head having a cutter controllably movable thereon for cutting the boundary of the hole in a selected direction relative to the position of the cutter head; said method comprising the steps of:

mining a hole into a coal seam with a mining machine;

repeatedly measuring the position of the boundary of the mined hole along its length as the hole is being mined;

repeatedly measuring the thickness of the coal adjacent the boundary of the mined hole along its length as the hole is being mined;

automatically computing from data derived from the measurements the volume of coal recovered from said seam;

generating an output signal representative of the portion of coal recovered from the seam.

30. The method of claim 29 further comprising the steps of:

generating an output signal representative of the current ratio of mined to unmined coal at the point in the hole currently being mined.

31. The method of claim 30 further comprising the step of:

displaying for an operator information relating to the recovery rate of the mined coal.

32. A highwall mining machine comprising:

a power head located on a bench adjacent the highwall;

a cutter head operable to cut a mined hole into a coal seam when thrust thereagainst;

a compression beam extending between the power head and the cutter head for thrusting the cutter head forward against the seam with force delivered by the power head;

said cutter head having a cutter controllably movable thereon for cutting the boundary of the hole in a selected direction relative to the position of the cutter head;

means for repeatedly measuring the position of the boundary of the mined hole along its length as the hole is being mined; and means for automatically computing from data derived from the measurements the volume of coal mined from the seam.

33. The machine of claim 32 further comprising:

means for displaying for an operator a signal representative of the rate at which coal is being mined from the hole.

34. A highwall mining machine comprising:

a power head located on a bench adjacent the highwall;

a cutter head operable to cut a mined hole into a coal seam when thrust thereagainst;

a compression beam extending between the power head and the cutter head for thrusting the cutter head forward against the seam with force delivered by the power head;

said cutter head having a cutter controllably movable thereon for cutting the boundary of the hole in a selected direction relative to the position of the cutter head;

means for measuring the position of the boundary of the mined hole at different points along its length as the hole is being mined;

means for measuring the thickness of the coal adjacent the boundary of the mined hole at different points along its length as the hole is being mined;

a data storage medium for storing data from said boundary position measurement and from said coal thickness measurement;

means for controlling the operation and movement of said cutter to shape the boundary of the mined hole in accordance with the stored data.

35. The machine for claim 34 further comprising:

means for graphically displaying to the operator, from the stored boundary data, a map of the mined hole as it is being mined;

means for graphically displaying to the operator as the hole is being mined, from the stored coal thickness data, a map of the coal seam adjacent the mined hole;

means for graphically displaying to the operator the hole is being mined from boundary data stored during the mining of an adjacent previously mined hole, a map of the previously mined hole; and means for graphically displaying to the operator as the hole is being mined, from coal thickness data stored during the mining of an adjacent previously mined hole, a map of the coal seam adjacent the previously mined hole.

36. The machine of claim 34 wherein the controlling means includes means for controlling the cutter position with respect to the cutter head and means for controlling the thrust of the cutter head.

37. The machine of claim 34 further comprising:

means for organizing said stored data to communicate to the controller of the machine the relative positions of contours and fault lines affecting the shape of the coal seam.

38. The machine of claim 37 wherein said communicating means further comprises:

means for displaying for the view of a human operator a contour map of a seam boundary including a plurality of plots of data each derived from data from a different one of a plurality of mined holes.

39. The apparatus of claim 34 further comprising:

a gathering pan; and means for controllably supporting the weight of said gathering pan to clear cut coal from the mined hole without unnecessarily cutting into the mined floor.

40. A highwall mining machine comprising:

a power head locateable on a bench adjacent a highwall;

a cutter head operable to cut a mined hole into a coal seam when thrust thereagainst;

a compression beam extending between the power head and the cutter head for thrusting the cutter head forward against the seam with force delivered by the power head;

said cutter head having a cutter controllably moveable thereon for cutting the boundary of the hole in a selected direction relative to the position of the cutter head;

means for measuring the position of the boundary of the mined hole at different points along its length as the hole is being mined;

means for measuring the thickness of the coal adjacent the boundary of the mined hole at different points along its length as the hole is being mined;

data storage means for storing data from said boundary position measurement coal thickness measurements;

means for graphically displaying to the operator, from the stored boundary data, a map of the mined hole as it is being mined;

means for graphically displaying to the operator as the hole is being mined, from the stored coal thickness data, a map of the coal seam adjacent the mined hole;

means for graphically displaying to the operator as the hole is being mined, from boundary data stored during the mining of a previously mined hole, a map of said previously mined hole; and means for graphically displaying to the operator as the hole is being mined, from coal thickness data stored during the mining of an adjacent previously mined hole, a map of the coal seam adjacent the previously mined hole.

* * * * *

UNITED STATES PATENT AND TRADEMARK OFFICE

CERTIFICATE OF CORRECTION

PATENT NO. : 4,952,000

DATED : August 28, 1990

INVENTOR(S) : Thomas Lipinski, Eugene Dunaway, and Manfred Jasser

It is certified that error appears in the above-identified patent and that said Letters Patent is hereby corrected as shown below:

Column 13, lines 16 and 17, "XT" should be --$X_T$--, and "XB" should be --$X_B$--.

Column 23, line 61, claim 35, after "operator" insert --as--.

Signed and Sealed this

Twenty-eighth Day of April, 1992

*Attest:*

HARRY F. MANBECK, JR.

*Attesting Officer*

*Commissioner of Patents and Trademarks*